US010673185B2

(12) United States Patent
I

(10) Patent No.: US 10,673,185 B2
(45) Date of Patent: Jun. 2, 2020

(54) OVERHEATING DESTRUCTIVE SWITCH

(71) Applicant: GREEN IDEA TECH INC., Mahe (SC)

(72) Inventor: Hsiang-Yun I, Tainan (TW)

(73) Assignee: GREEN IDEA TECH INC., Mahe, Seychelles ( * ) Notice: Subject to any disclaimer, the term of this patent is extended or adjusted under 35 U.S.C. 154(b) by 0 days.

(21) Appl. No.: 16/215,618

(22) Filed: Dec. 10, 2018

(65) Prior Publication Data

US 2020/0014157 A1 Jan. 9, 2020

(30) Foreign Application Priority Data

Jul. 3, 2018 (TW) ..... 107123018 A

(51) Int. Cl.
*H01R 13/713* (2006.01)
*H01H 3/02* (2006.01)
(Continued)

(52) U.S. Cl.
CPC ..... *H01R 13/7137* (2013.01); *H01H 3/022* (2013.01); *H01H 3/12* (2013.01);
(Continued)

(58) Field of Classification Search
CPC .. H01R 13/7137; H01R 25/003; H01H 3/022; H01H 3/12; H01H 3/54; H01H 1/24;
(Continued)

(56) References Cited

U.S. PATENT DOCUMENTS 3,737,825 A * 6/1973 Summe ..... H01H 73/30 337/91
4,220,836 A * 9/1980 Hersey ..... H01H 35/343 200/83 P
(Continued)

FOREIGN PATENT DOCUMENTS

CN 103441019 B 10/2015
TW 321352 11/1997
(Continued)

*Primary Examiner* — Jayprakash N Gandhi
*Assistant Examiner* — Stephen S Sul
(74) *Attorney, Agent, or Firm* — Michael D. Eisenberg

(57) ABSTRACT

An overheating destructive switch, comprising: a first conductive element, a second conductive element, a movable conductive element, an overheating destructive element, an operating component, and a second elastic element. The movable conductive element connects the first conductive element and the second conductive element. A first elastic element and the second elastic element act on an operating element. The first elastic element is compressed and has a first elastic force, and the second elastic element has a second elastic force. The first elastic force is greater than the second elastic force under in a normal state. When the overheating destructive element is destroyed due to overheating, the first elastic force is reduced or lost, such that the second elastic force becomes greater than the first elastic force. The movable conductive element is consequently disconnected from the first conductive element and the second conductive element, thus achieving protection against overheating.

10 Claims, 14 Drawing Sheets

(51) Int. Cl.
*H01H 3/12* (2006.01)
*H01H 3/54* (2006.01)
*H01H 1/24* (2006.01)
*H01R 25/00* (2006.01)

(52) U.S. Cl.
CPC ..... *H01H 3/54* (2013.01); *H01H 1/24* (2013.01); *H01H 2221/016* (2013.01); *H01H 2221/044* (2013.01); *H01H 2221/068* (2013.01); *H01H 2239/06* (2013.01); *H01R 25/003* (2013.01)

(58) Field of Classification Search
CPC ..... H01H 2221/044; H01H 2221/016; H01H 2239/06; H01H 2221/068; H01H 13/20; H01H 85/08; H01H 13/56
USPC ..... 337/298, 388, 401, 407
See application file for complete search history.

(56) References Cited

U.S. PATENT DOCUMENTS 4,295,114 A * 10/1981 Pohl ..... H01H 37/764 337/3
4,697,053 A * 9/1987 Lockard ..... H01H 23/20 200/303
5,694,106 A * 12/1997 Wang ..... H01H 71/16 337/79
5,861,794 A * 1/1999 Pellon ..... H01H 77/04 337/348
6,573,466 B1 * 6/2003 Rapp ..... H01H 13/063 200/302.2
6,734,779 B2 * 5/2004 Yu ..... H01H 73/26 337/56
6,876,290 B2 * 4/2005 Yu ..... H01H 73/26 337/56
7,132,616 B1 * 11/2006 Radosavljevic ..... H01H 23/168 200/553
9,698,542 B1 7/2017 I
2004/0100354 A1 * 5/2004 Davis ..... H01H 37/5409 337/356
2014/0251780 A1 * 9/2014 Ishikawa ..... H01H 23/148 200/561
2016/0006235 A1 * 1/2016 Wang ..... H02H 3/38 361/91.2
2017/0047180 A1 * 2/2017 Wang ..... H01C 7/12
2017/0148602 A1 * 5/2017 Wang ..... H01H 37/761
2019/0066887 A1 * 2/2019 Wang ..... H01C 7/12

FOREIGN PATENT DOCUMENTS

TW 560690 11/2003
TW 250403 11/2004
TW 382568 6/2010

* cited by examiner

OVERHEATING DESTRUCTIVE SWITCH

CROSS REFERENCES TO RELATED APPLICATIONS

The present application claims priority from Taiwanese Patent Application Serial Number 107123018, filed Jul. 3, 2018, the disclosure of which is hereby incorporated by reference herein in its entirety.

BACKGROUND OF THE INVENTION

(a) Field of the Invention

The present invention relates to an overheating destructive switch and, more particularly, to an electrical disconnection structure which differs from a fuse and a bimetallic strip. An overheating destructive element of the present invention is not dependent on currents flowing through for destruction, but carries out destruction by means of heat energy transmission so as to electrically disconnect the switch.

(b) Description of the Prior Art

A rocker switch of the prior art controls a switch to move reciprocally and pivotally within a certain angular range so as to control the switch to be connected or disconnected; for instance, in R.O.C. Patent No. 560690 which is entitled "Spark Shielding Structure of Switch", when the switch makes a pivotal movement, a position-fixing feature is used to fix the switch in a first position or a second position so as to make the switch connected or disconnected.

In a conventional push switch, a push operation can be used to repeatedly control connection and disconnection of the switch each time, and a button thereof utilizes a reciprocal button structure similar to a conventional automatic ball-point pen, such that the button of the switch is fixed in a lower position or an upper position each time when the button is pushed; for instance, the push switch disclosed in China Patent No. CN103441019 entitled "Button Switch".

In R.O.C. Patent No. 321352 which is entitled "Improved Structure of the On-wire Switch", a switch structure having a fuse is disclosed, and yet the fuse is located in a path of a live wire of a power source, which means a current is required to flow through for the protection effect to be available, given that only an overloaded current is capable of melting the fuse, and since a fuse is required to allow currents to flow through during operation but also must be capable of being melted when there are excessive currents, a lead-tin alloy or zinc having low melting points are often used as fuses, of which the conductive performances are much poorer than that of copper. Using an extension cord as an example, in which copper is mainly used as a conducting body, if the extension cord has combined therein the switch of the R.O.C. Patent No. 321352 for controlling a power source, the conductivity of the fuse would be poor, which leads to the issue of excessive energy consumption.

In R.O.C. Patent No. M382568 which is entitled "Bipolar Type Auto Power Off Safety Switch", an overload protection switch having a form of a bimetallic strip is disclosed, but the bimetallic strip is likewise required to be located in a path where currents flow through and is dependent on currents flowing through to generate deformations, and particularly overloaded currents are required because only the overloaded currents are capable of deforming the bimetallic strip to interrupt a circuit.

In R.O.C. Patent No. M250403 which is entitled "Overload Protection Switch Structure for Group Type Socket", an overload protection switch is applied to an extension cord, and the overload protection switch of the prior art has a bimetallic strip provided therein; when a total power of the entire extension cord exceeds a threshold, the bimetallic strip automatically pops off due to deformation from overheating, so as to achieve power-off protection. Yet the bimetallic strip is dependent on currents flowing through for the overload protection to be available, and since the conductivity of the bimetallic strip is poorer than that of copper, it also leads to the issue of excessive energy consumption.

However, apart from overheating resulted from current overload; using an extension cord as an example, any of the following circumstances could result in overheating of any power socket thereof, including:

1. The metal pins of a plug are severely oxidized and the metal pins are covered by oxidized substances; when the plug is inserted into the power socket, the poorly conductive oxidized substances make the resistance greater and thus causing overheating in the power socket.

2. When the metal pins of the plug is inserted into the power socket, but the insertion is incomplete and results in only local contacts, an excessively small contact area causes overheating in the power socket.

3. The metal pins of the plug is deformed or worn out, which results in incomplete contact when the plug is inserted, and an excessively small contact area causes overheating in the power socket.

4. The metal pins of the plug or the metal members of the power socket are covered by foreign materials such as dusts or dirt, which makes the conductivity poorer and causes overheating due to increased resistance.

Under the above-mentioned circumstances, the working temperature where the power socket is located acutely differs from where the overload protection switch is located.

In U.S. Pat. No. 9,698,542 which is entitled "Assembly and Method of Plural Conductive Slots Sharing an Overheating Destructive Fixing Element", the inventor has disclosed an experiment showing a relationship between copper plate distances and temperature variations. The test shown in Table 2 of the U.S. Pat. No. 9,698,542 indicates that if the overheated power socket is located in a position 10 of the experiment of Table 2, and the overload protection switch is located in a position 1 of the experiment of Table 2, in which the two positions are 9 cm apart; when the working temperature of the power socket reaches 202.9° C., the working temperature of the overload protection switch is only 110.7° C. after 25 minutes. That is, when the power socket and the overload protection switch are 9 cm apart from each other; and the working temperature of the power socket has become overheated and reached 202.9° C. and could cause accidental combustion, the bimetallic strip of the overload protection switch was still only 110.7° C., which did not reach the temperature of deformation and thus the overload protection switch would not automatically interrupt the power connection.

Since there are many different types of circumstances for causing overheating in a power socket, and the distance between the power socket and the bimetallic strip of the overload protection switch causes a great difference in temperature, each power socket of the extension cord should be provided with an overload protection switch in order to effectively achieve protection against overheating. However, the overload protection switch employing the form of a bimetallic strip is more costly, and would result in a significant increase in price if each power socket of an extension cord is to be provided with an overload protection switch, which lead the overload protection switch to go against it being available to all.

SUMMARY OF THE INVENTION

On the basis of the aforesaid shortcomings, the present invention discloses an overheating destructive switch, mainly comprising: a base, a first conductive element, a second conductive element, a movable conductive element, an overheating destructive element, and an operating component. The base has a receiving space. The first conductive element and the second conductive element are both penetrated into and provided in the base. The movable conductive element is provided in the receiving space, and the movable conductive element is electrically connected to the first conductive element and selectively connected to the second conductive element. The overheating destructive element can be destroyed at a destructive temperature and the destructive temperature is between 100° C. to 250° C.; the overheating destructive element is located on the movable conductive element. The operating component is assembled on the base and comprises an operating element and a first elastic element, in which the first elastic element is compressively limited between the overheating destructive element and the operating element and has a first elastic force. The overheating destructive switch further comprises a second elastic element. The second elastic element has a second elastic force which acts on the operating element.

Accordingly, when the operating element is in a first position, the first elastic force forces the movable conductive element to be contacted with the second conductive element so as to form an electrically connected state; in the electrically connected state, currents flow through the first conductive element, the movable conductive element and the second conductive element to generate a heat energy, and the overheating destructive element absorbs the heat energy and be destroyed at the above-described destructive temperature, such that the first elastic force is reduced or lost, thus making the second elastic force to be greater than the first elastic force, and the second elastic force forces the operating element to be moved to a second position, thus the movable conductive element becomes separated from the second conductive element to form an electrically disconnected state.

In addition, the first elastic element and the second elastic element are both springs.

In addition, the movable conductive element is a rocker conductive element, in which the rocker conductive element is movably provided over the first conductive element, and the rocker conductive element is contacted with or separated from the second conductive element in a manner of rocking motions.

In addition, the operating element is provided with a pivotal point, in which the pivotal point is pivotally connected to the base; the operating element can be rotated reciprocally in a limited manner by having the pivotal point as an axle center; the first elastic element is fixedly connected to the operating element and the overheating destructive element, and the first elastic element is located in a position adjacent to the pivotal point; the first elastic element is bent and deformed along with rotations of the operating element.

In addition, the rocker conductive element has an accommodating groove in a position adjacent to the first conductive element, in which the overheating destructive element is located in the accommodating groove.

In addition, the rocker conductive element is integrally bent to form a first wall, a second wall, and a bottom wall, in which the aforesaid accommodating groove is defined among the first wall, the second wall and the bottom wall.

In addition, stopping walls are extended from two sides of the bottom wall, in which the aforesaid accommodating groove is collectively defined among the first wall, the second wall, the bottom wall and the stopping walls.

In addition, the rocker conductive element has a fixing bulge in a position adjacent to the first conductive element, in which the overheating destructive element is sleeved on the fixing bulge.

In addition, the rocker conductive element has a fixing hole in a position adjacent to the first conductive element; further comprising a thermal conductive shell, in which the thermal conductive shell includes a protruding pillar which is located at one end of the thermal conductive shell and inserted into the fixing hole; the overheating destructive element is mounted into the thermal conductive shell.

In addition, the overheating destructive element may be a block, a pillar, a cap, a sphere or an irregular body.

In addition, the movable conductive element is a conductive cantilever element, the second elastic element is a spring plate, and the first conductive element, whereby the spring plate and the conductive cantilever element are integrally formed.

In addition, the conductive cantilever element has a mounting portion, in which the mounting portion comprises a recess and the overheating destructive element is located in the recess of the mounting portion.

The present invention also discloses a power socket having a switch, comprising the aforesaid overheating destructive switch, a live wire pin, a live wire conductive element, a neutral wire conductive element, and a shell. The shell comprises a live wire jack and a neutral wire jack. The live wire pin is electrically connected to the second conductive element. The live wire pin comprises a live wire slot which corresponds to the live wire jack. The live wire conductive element comprises a live wire connection end which is electrically connected to the first conductive element. The neutral wire conductive element comprises a neutral wire slot which corresponds to the neutral wire jack.

In addition, there are a plurality of overheating destructive switches; a plurality of live wire jacks; and a plurality of live wire pins. Each of the live wire pins is individually and electrically connected to each of the second conductive elements; the live wire conductive element comprises a plurality of live wire connection ends, and each of the live wire connection ends is electrically connected to each of the conductive elements. There are a plurality of neutral wire jacks; a plurality of neutral wire slots, and all of the neutral line slots are serially connected to the neutral wire conductive element.

The following effects can be achieved according to the aforesaid technical features:

1. In comparison with the conventional protection technologies using a fuse or a bimetallic strip, the overheating destructive element of the present invention is not located in a path of current transmission and is not responsible for transmitting currents; therefore, when the present invention is applied to an electrical appliance or an extension cord, the current transmission of the electrical appliance or the extension cord will not be hampered even though the conductivity of the overheating destructive element is not as good as that of copper or is even a non-conducting insulative body.

2. The overall structure is simple and easy to manufacture without increasing a size of the switch obviously, and the production cost is relatively lower and easy to be implemented in known rocker switches, push switches or other switches.

3. The small size and low cost is suitable for applications to switches of an extension cord. For example, installing each of the power socket of the extension cord with an overheating destructive switch ensures the safety of each set of socket apertures corresponding to each of the switches when in use, and also redresses the high cost of conventional bimetallic strips, and the shortcoming thereof whereby a plurality of sets of socket apertures are required to jointly use one overload protection switch, which will not protect socket apertures distanced further away from the overload protection switch that are already overheating, resulting in an increase in temperature thereof, but the overload protection switch has still not tripped because the temperature has not yet reached the trip temperature.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

In summary of the above-described technical features, the main effects of the overheating destructive switch and the power socket thereof of the present invention can be clearly illustrated in the following embodiments.

Figure 1:
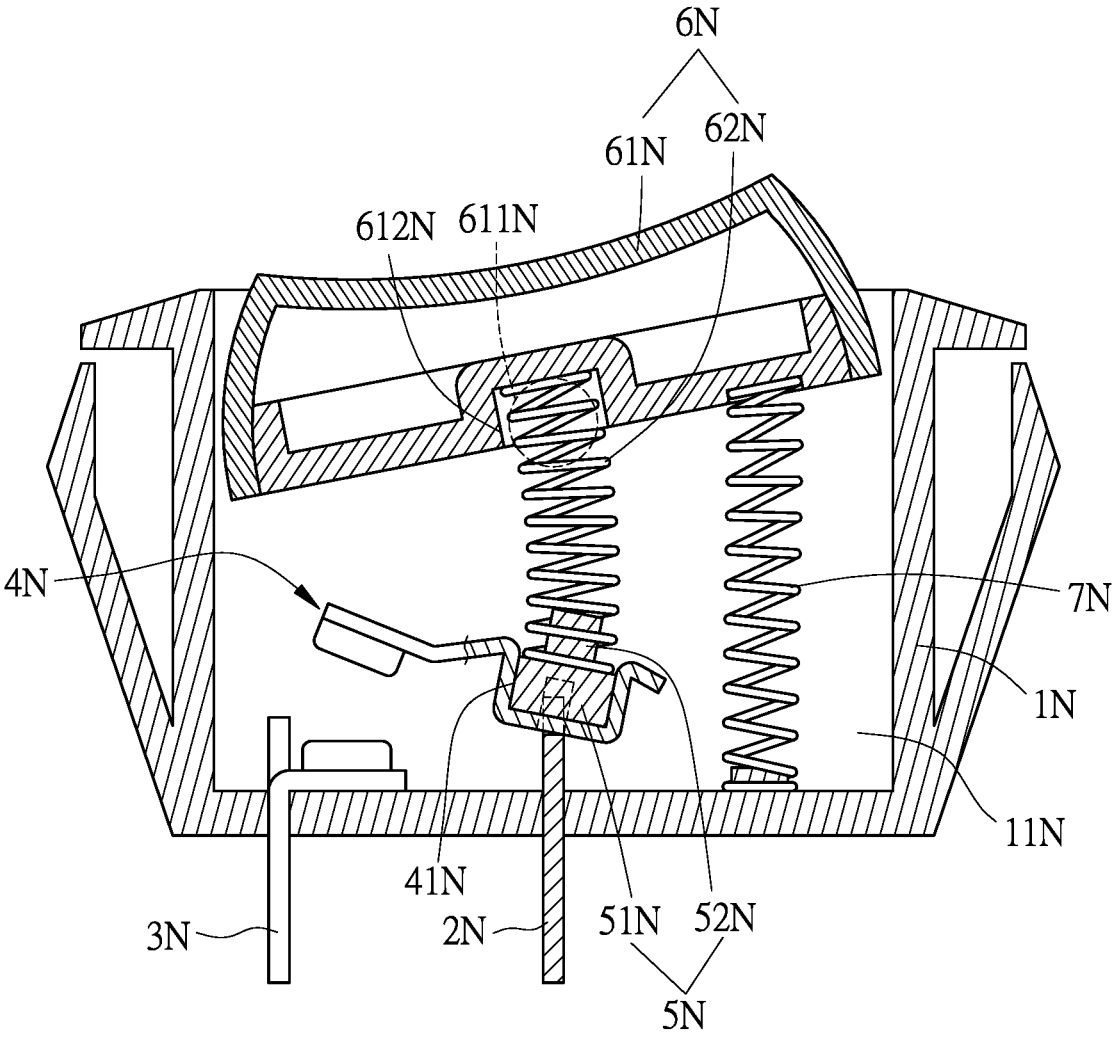
FIG. 1 is a sectional view in accordance with a first embodiment of the present invention and illustrates a structure of a rocker switch and that the rocker switch is in a disconnected state.

Referring to FIG. 1 for a first embodiment of the present invention, an overheating destructive switch of the embodiment is in a form of a rocker switch, wherein FIG. 1 shows that the rocker switch is in a disconnected state.

Figure 2:
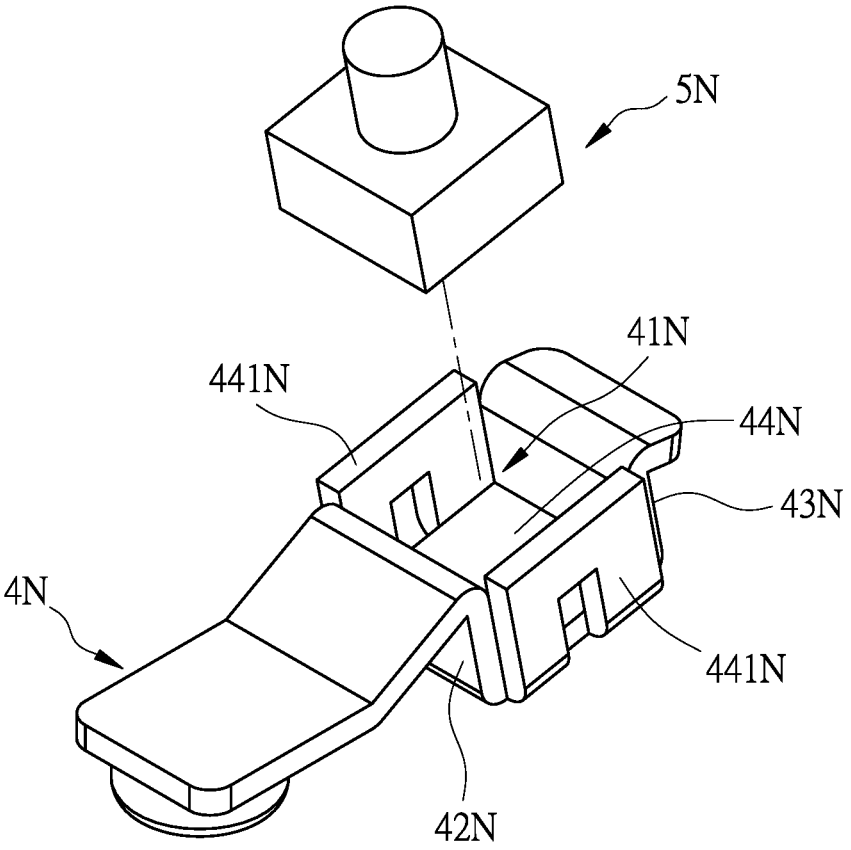
FIG. 2 is a disassembled view showing a rocker conductive element and an overheating destructive element in accordance with the first embodiment of the present invention.

The rocker switch comprises: a base (1N) having a receiving space (11N); a first conductive element (2N) and a second conductive element (3N) penetrated into and provided in the base (1N); a movable conductive element (which can be referred to as a rocker conductive element (4N) in this embodiment) provided in the receiving space (11N); an overheating destructive element (5N); an operating component (6N) assembled on the base (1N), wherein the operating component (6N) comprises an operating element (61N) and a first elastic element (62N); and a second elastic element (7N). In which:

the rocker conductive element (4N) is provided over the first conductive element (2N) and electrically connected to the second conductive element (3N). The overheating destructive element (5N) is provided on the rocker conductive element (4N). Preferably, a part of the rocker conductive element (4N) corresponding to the first conductive element (2N) is provided with an accommodating groove (41N) for accommodating the overheating destructive element (5N) therein. The overheating destructive element (5N) can be destroyed at a destructive temperature, and the destructive temperature is between 100° C. to 250° C. It should be noted that the overheating destructive element (5N) is not used to maintain the continuous supply of currents, and thus can be selectively made of an insulative material such as a plastic, or selected from a non-insulative material such as an alloy having a low melting point; for example, an alloy consisted of bismuth and any one or more of cadmium, indium, silver, tin, lead, antimony and copper, or other metals or alloys having a low melting point between 100° C. to 250° C., wherein a tin-bismuth alloy has a melting point approximately between 138° C. to 148° C. according to different compositions. Referring to FIG. 2, to illustrate in further details, the overheating destructive element (5N) can be a block, but can also be a pillar, a cap, a sphere or an irregular body, which are also feasible embodiments. The rocker conductive element (4N) may be integrally bent to form a first wall (42N), a second wall (43N) and a bottom wall (44N), in which the aforesaid accommodating groove (41N) is defined among the first wall (42N), the second wall (43N) and the bottom wall (44N). Preferably, stopping walls (441N) are further extended from two sides of the bottom wall (44N), in which the aforesaid accommodating groove (41N) is collectively defined between the first wall (42N), the second wall (43N), the bottom wall (44N) and the stopping walls (441N) so as to more preferably accommodate the overheating destructive element (5N).

Referring back to FIG. 1, the first elastic element (62N) is compressively limited between the overheating destructive element (5N) and the operating element (61N) and has a first elastic force. Further, the overheating destructive element (5N) comprises a destructive portion (51N) and a bulge (52N). For example, the first elastic element (62N) is a spring; the first elastic element (62N) is fixedly connected to the operating element (61N) and the overheating destructive element (5N). In this embodiment, the first elastic element (62N) has one end thereof fixedly pressed against the destructive portion (51N). The bulge (52N) is located on the destructive portion (51N), and the bulge (52N) extends into the first elastic element (62N). The second elastic element (7N) is a spring in the embodiment, and the second elastic element (7N) has a second elastic force; the second elastic force acts on the operating element (61N), and the first elastic force is greater than the second elastic force as shown in FIG. 1.

The operating component (6N) is used to operate the rocker conductive element (4N) to be connected to the first conductive element (2N) and the second conductive element (3N). It should be noted that in the overheating destructive switch, the first conductive element (2N) is used as a first end of the live wire, and the second conductive element (3N) is used as a second end of the live wire. If overheating occurs in a circuit, a disconnection is preferably generated in the live wire. Therefore, a live wire connection may be formed by connecting the rocker conductive element (4N) to the first conductive element (2N) and the second conductive element (3N), or a live wire disconnection may be formed by disconnecting the first conductive element (2N) from the second conductive element (3N). The operating element (61N) has a pivotal point (611N), wherein the pivotal point (611N) is pivotally connected to the base (1N), such that the operating element (61N) can be rotated reciprocally in a limited manner by having the pivotal point (611N) as an axle center. In the embodiment, the operating element (61N) has a recess (612N) on an internal surface thereof, and a portion of the first elastic element (62N) extends into the recess (612N).

Figure 3:
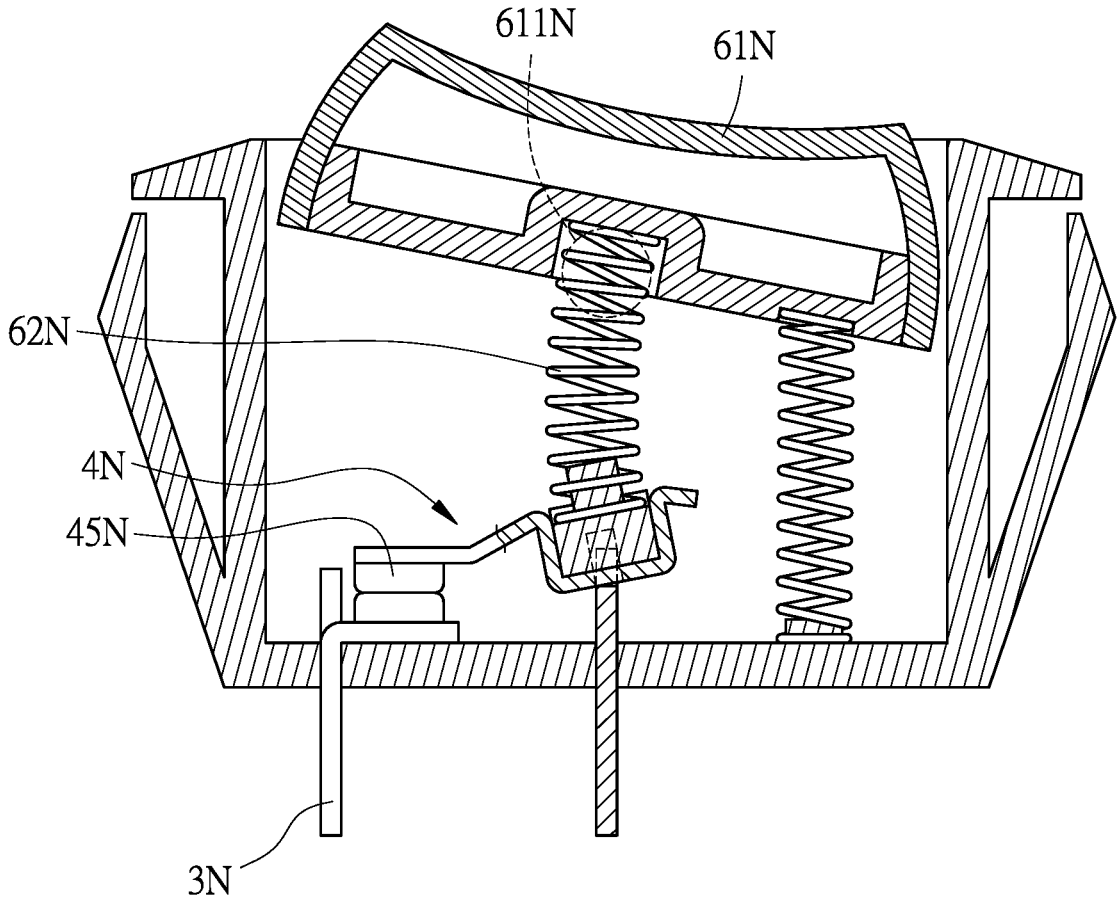
FIG. 3 is a sectional view in accordance with the first embodiment of the present invention and illustrates that the rocker switch is in a connected state.

Referring to FIG. 3, a user may operate and enable the operating element (61N) to rotate around the pivotal point (611N), and since the first elastic element (62N) is located in a position adjacent to the pivotal point (611N), the first elastic element (62N) is bent and deformed along with the rotation of the operating element (61N), so as to enable the first elastic element (62N) to drive the rocker conductive element (4N) to be selectively contacted with or separated from the second conductive element (3N) in a manner of rocking motions. When the first elastic element (62N) drives the rocker conductive element (4N) to positionally move towards the second conductive element (3N), the first elastic force forces a silver contact point (45N) of the rocker conductive element (4N) to be contacted with the second conductive element (3N) and form an electrically connected state.

Figure 4:
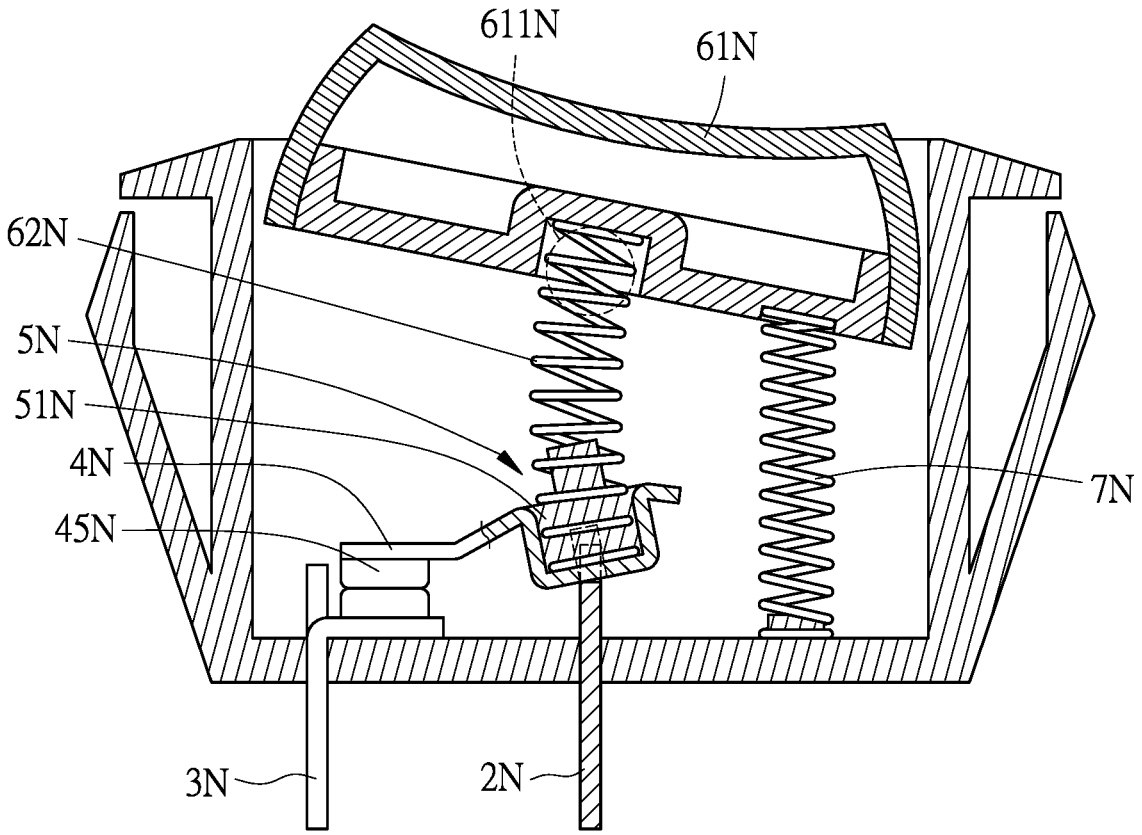
FIG. 4 is a sectional view in accordance with the first embodiment of the present invention and illustrates that the overheating destructive element is in an overheated and destroyed state.
Figure 5:
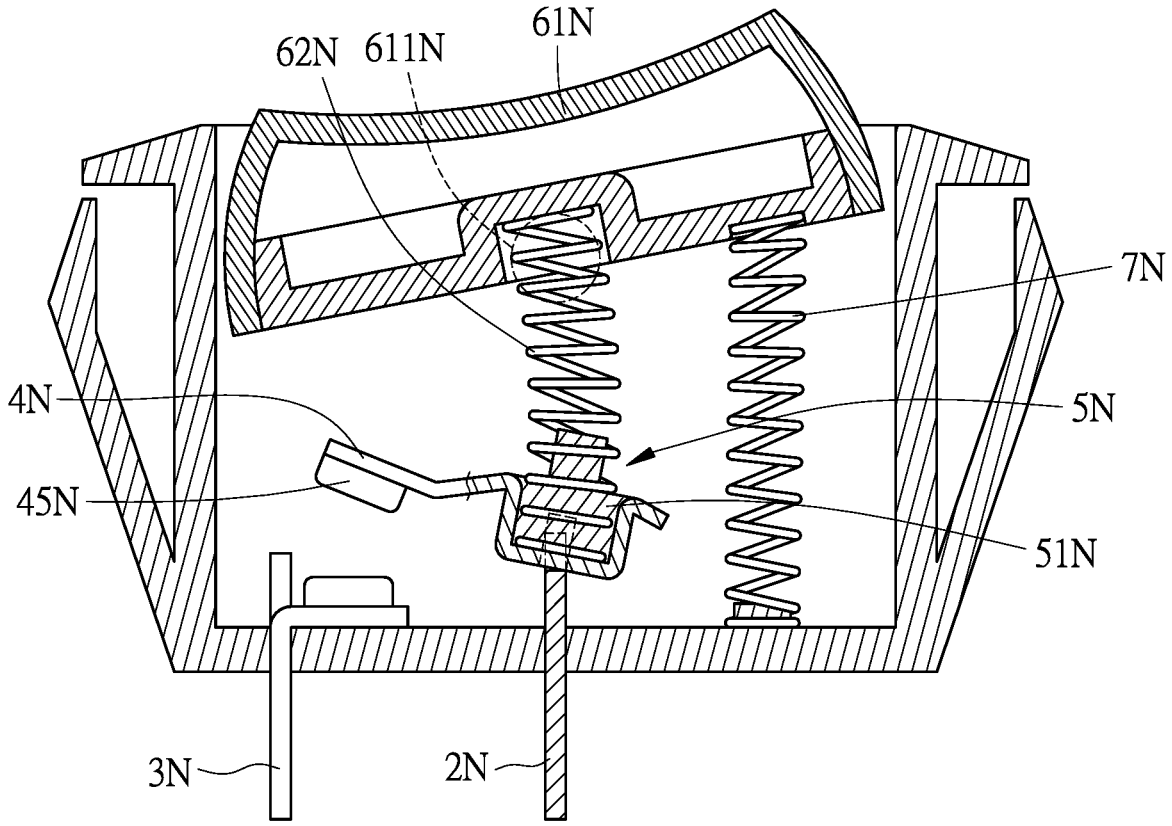
FIG. 5 is a sectional view in accordance with the first embodiment of the present invention and illustrates that when the overheating destructive element is overheated and destroyed, a movable conductive element is separated from a second conductive element so as to enable the rocker switch to be returned to the disconnected state from the connected state.

Referring to FIGS. 4 and 5, when an external conducting apparatus connected to the first conductive element (2N) or the second conductive element (3N) is in an abnormal state; for example, the external conducting apparatus may be a power socket, and when there are oxidized substances, dusts, incomplete insertion of metal pins and deformations of metal pins present between the metal pins of a plug and the power socket, consequently resulting in the generation of a greater heat energy in a conductive part of the power socket, the heat energy is transmitted to the rocker conductive element (4N) via the first conductive element (2N) or the second conductive element (3N), and then transmitted to the destructive portion (51N) of the overheating destructive element (5N) via the rocker conductive element (4N), the destructive portion (51N) absorbs the heat energy and gradually loses a rigidity thereof before reaching a material melting point thereof; for instance, the overheating destructive element (5N) may be made of a tin-bismuth alloy, and although a melting point thereof is 148° C., the rigidity is reduced when a temperature thereof is close to the melting point; therefore, under the effect of the first elastic force, the destructive portion (51N) of the overheating destructive element (5N) is pressed and deformed by the first elastic element (62N) or even broken, such that the first elastic force is reduced or lost, and the second elastic force becomes greater than the first elastic force at this moment. It should be further noted that in this embodiment, an arrangement direction of the first elastic element (2N) and the second elastic element (3N) is defined as a longitudinal direction, and the operating element (61N) has a length in the longitudinal direction; the first elastic element (62N) is configured in a central position of the length, and a distance is present between a configured position of the second elastic element (7N) and the central position; therefore, when the second elastic force becomes greater than the first elastic force, a torque effect forces the operating element (61N) to rotate on the pivotal point (611N) as an axle center, and also enables the first elastic element (62N) to drive the rocker conductive element (4N) to move positionally, thereby forcing the operating element (61N) to be moved to a position of disconnection which resulting the silver contact point (45N) of the rocker conductive element (4N) to be separated from the second conductive element (3N), and in consequence, forming a state of electrical disconnection and achieving protection against overheating.

Figure 6:
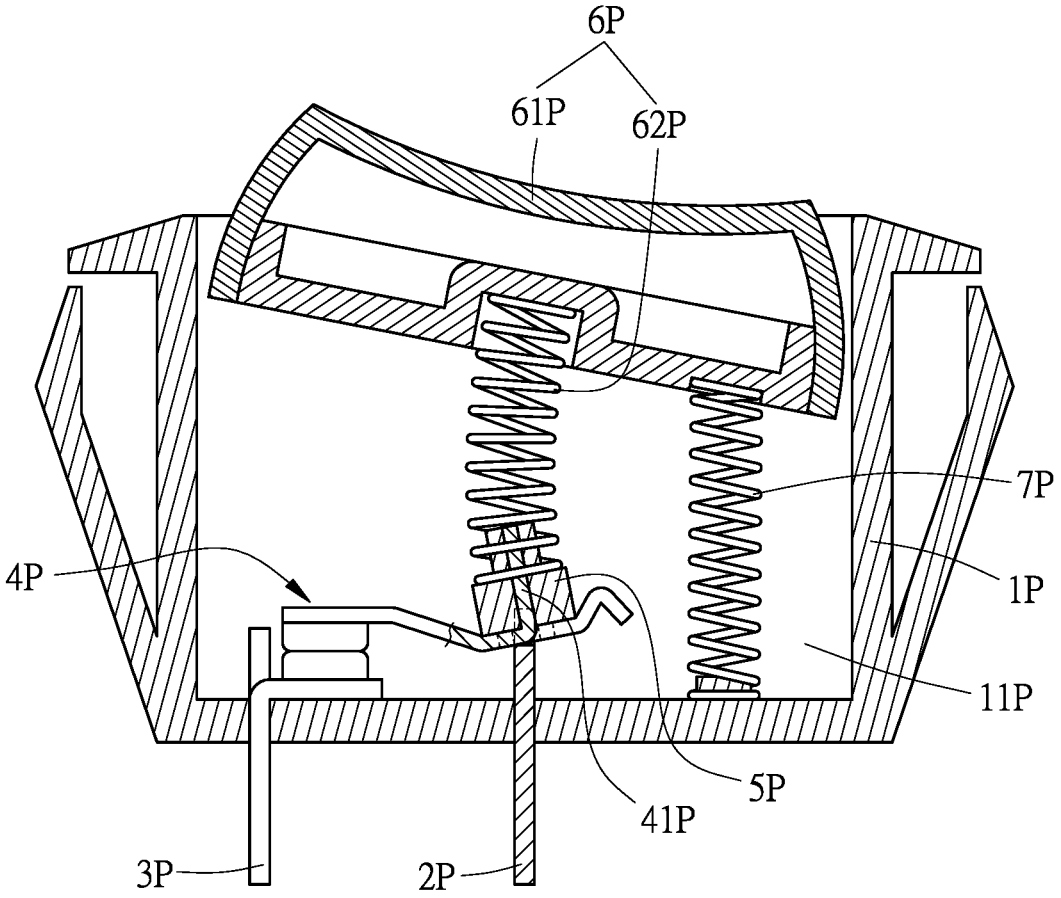
FIG. 6 is a sectional view in accordance with a second embodiment of the present invention.
Figure 7:
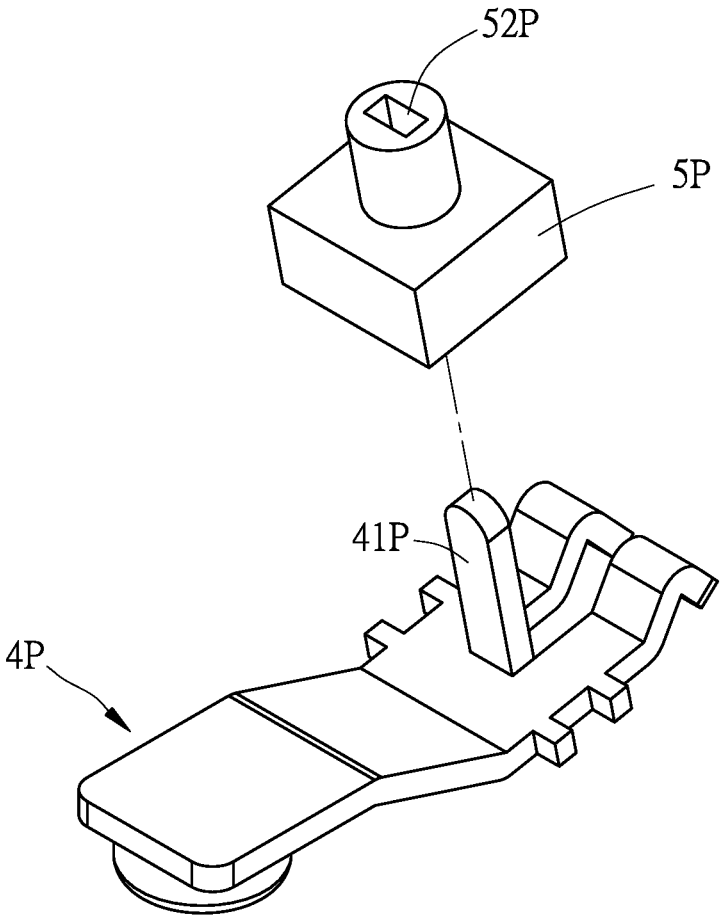
FIG. 7 is a disassembled view showing a rocker conductive element and an overheating destructive element in accordance with the second embodiment of the present invention.

Referring to FIGS. 6 and 7 for a second embodiment of the present invention, an overheating destructive switch is shown in the embodiment and is in a form of a rocker switch, wherein FIG. 6 shows that the rocker switch is in a connected state. The embodiment is approximately the same as the first embodiment, which comprises a base (1P) having a receiving space (11P); a first conductive element (2P) and a second conductive element (3P) penetrated into and provided in the base (1P); a movable conductive element (which can be referred to as a rocker conductive element (4P) in this embodiment) provided in the receiving space (11P); an overheating destructive element (5P); an operating component (6P) assembled on the base (1P), wherein the operating component (6P) comprises an operating element (61P), a first elastic element (62P), and a second elastic element (7P); the second embodiment differs from the first embodiment in that: a part of the rocker conductive element (4P) adjacent to the first conductive element (2P) is provided with a fixing bulge (41P) for enabling a sleeving hole (52P) of the overheating destructive element (5P) to be sleeved on the fixing bulge (41P). Accordingly, the overheating destructive element (5P) can be steadily fixed to the rocker conductive element (4P).

Figure 8:
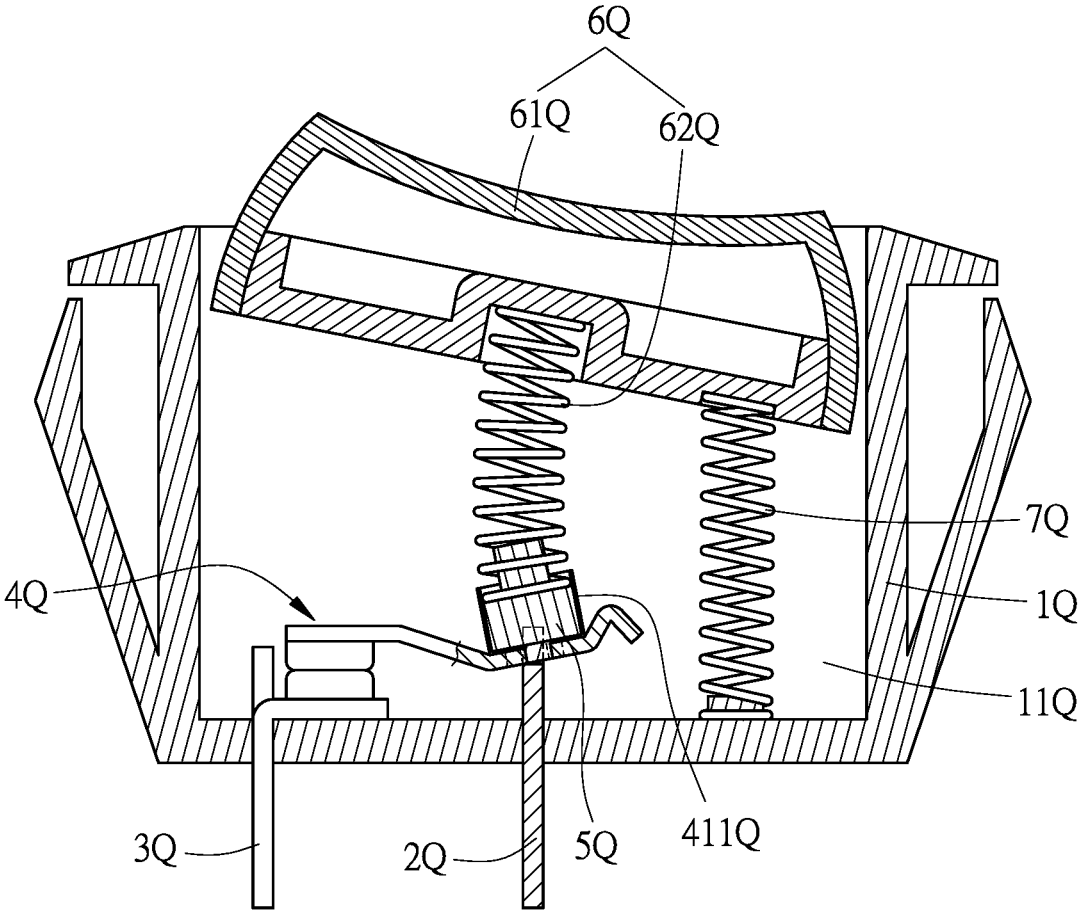
FIG. 8 is a sectional view in accordance with a third embodiment of the present invention.
Figure 9:
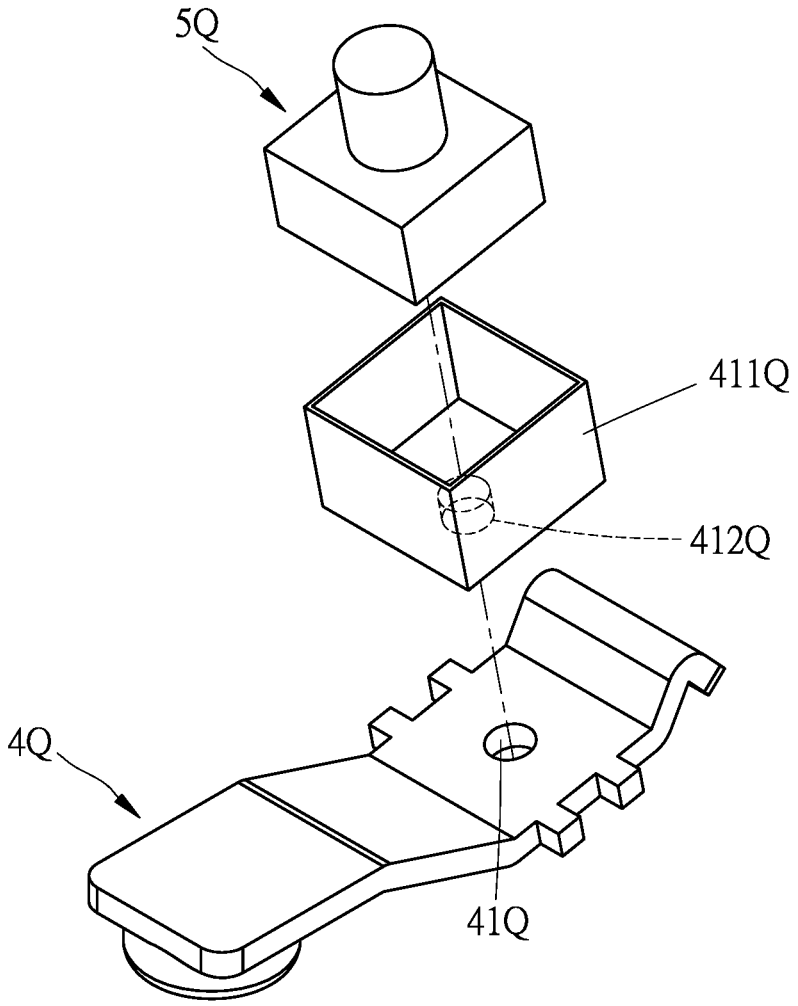
FIG. 9 is a disassembled view showing a rocker conductive element and an overheating destructive element in accordance with the third embodiment of the present invention.

Referring to FIGS. 8 and 9 for a third embodiment of the present invention, an overheating destructive switch is shown in the embodiment and is in a form of a rocker switch, wherein FIG. 8 shows that the rocker switch is in a connected state. The embodiment is approximately the same as the first embodiment, which comprises a base (1Q) having a receiving space (11Q); a first conductive element (2Q) and a second conductive element (3Q) penetrated into and provided in the base (1Q); a movable conductive element (which can be referred to as a rocker conductive element (4Q) in this embodiment) provided in the receiving space (11Q); an overheating destructive element (5Q); an operating component (6Q) assembled on the base (1Q), wherein the operating component (6Q) comprises an operating element (61Q), a first elastic element (62Q) and a second elastic element (7Q); the third embodiment differs from the first embodiment in that: a part of the rocker conductive element (4Q) adjacent to the first conductive element (2Q) is provided with a fixing hole (41Q); the rocker conductive element (4Q) further comprises a thermal conductive shell (411Q) which includes a protruding pillar (412Q); the protruding pillar (412Q) is located at one end of the thermal conductive shell (411Q) and inserted into the fixing hole (41Q); the thermal conductive shell (411Q) is used to accommodate the overheating destructive element (5Q). Accordingly, the overheating destructive element (5Q) can be steadily fixed to the rocker conductive element (4Q).

Figure 10:
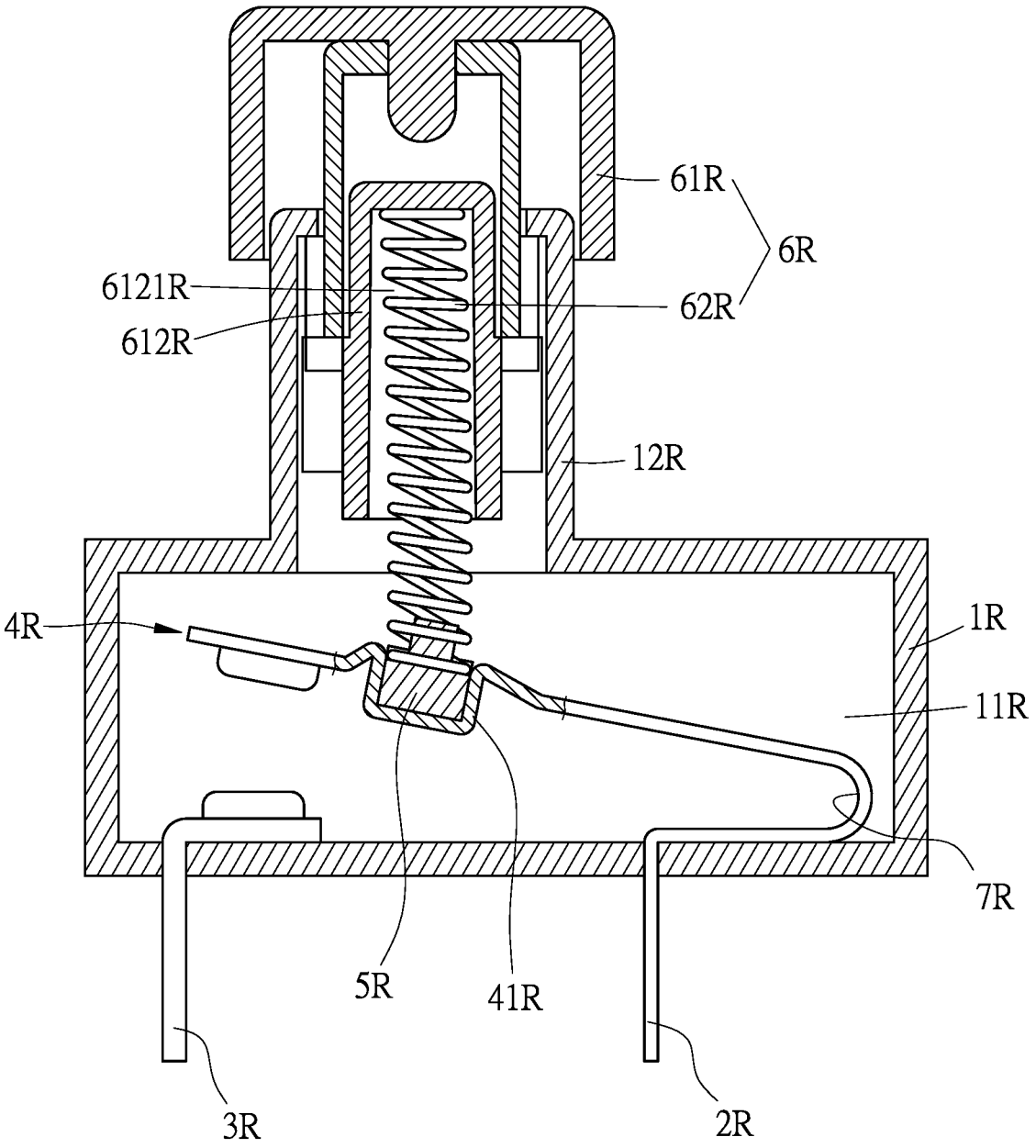
FIG. 10 is a sectional view in accordance with a fourth embodiment of the present invention.

Referring to FIG. 10 for a fourth embodiment of the present invention, an overheating destructive switch is shown in the embodiment and is in a form of a push switch, wherein FIG. 10 shows that the push switch is in a disconnected state.

The push switch comprises:

a base (1R) having a receiving space (11R) and a protruding portion (12R); a first conductive element (2R) and a second conductive element (3R) penetrated into and provided in the base (1R); a movable conductive element provided in the receiving space (11R), wherein the movable conductive element is a conductive cantilever element (4R); an overheating destructive element (5R) which can be destroyed at a destructive temperature, wherein the destructive temperature is between 100° C. to 250° C. The overheating destructive element (5R) is not used to maintain the continuous supply of currents, and thus can be selectively made of an insulative material such as a plastic but is not limited thereto, and can also be selected from a non-insulative material such as an alloy having a low melting point; for example, an alloy consisted of bismuth and any one or more of cadmium, indium, silver, tin, lead, antimony and copper, or other metals having a low melting point between 100° C. to 250° C.; for instance, a tin-bismuth alloy having a melting point approximately at 148° C. In this embodiment, the conductive cantilever element (4R) has a mounting portion (41R) thereon, and the overheating destructive element (5R) is provided on the mounting portion (41R). For example, the mounting portion (41R) comprises a recess, and the overheating destructive element (5R) is mounted in the recess.

It should be particularly noted that in the overheating destructive switch, if overheating occurs in a circuit, a disconnection is preferably generated in the live wire. Therefore, the first conductive element (2R) is used as a first end of the live wire, and the second conductive element (3R) is used as a second end of the live wire, such that a live wire connection may be formed by connecting the conductive cantilever element (4R) to the first conductive element (2R) and the second conductive element (3R).

The push switch of the embodiment further comprises an operating component (6R) for operating the conductive cantilever element (4R) to be connected to the first conductive element (2R) and the second conductive element (3R) to form a live wire connection, or to disconnect the connection between the first conductive element (2R) and the second conductive element (3R) so as to form an open circuit on the live wire. The operating component (6R) is assembled on the base (1R) and comprises an operating element (61R) and a first elastic element (62R), wherein the operating element (61R) is sleeved on the protruding portion (12R) and can be moved reciprocally in a limited manner on the protruding portion (12R). The reciprocal movement and the position-fixing structure of the whole operating component (6R) is the same as a push button structure in a conventional automatic ball-point pen, or the structure of the "Button Switch" disclosed in the prior art of China Patent No. CN103441019. Therefore, a few conventional position-fixing structures are omitted in the drawings of the embodiment. The operating element (61R) further comprises a limiting element (612R), wherein the limiting element (612R) is provided in an inwardly concaved accommodating space (6121R), and the first elastic element (62R) is provided in the accommodating space (6121R); the first elastic element (62R) is compressively limited between the overheating destructive element (5R) and the limiting element (612R).

The push switch of the embodiment further comprises a second elastic element, in which the second elastic element is a spring plate (7R), and the first elastic element (2R), the spring plate (7R) and the conductive cantilever element (4R) are integrally formed; the spring plate (7R) has a second elastic force which acts on the operating element (61R).

Figure 11:
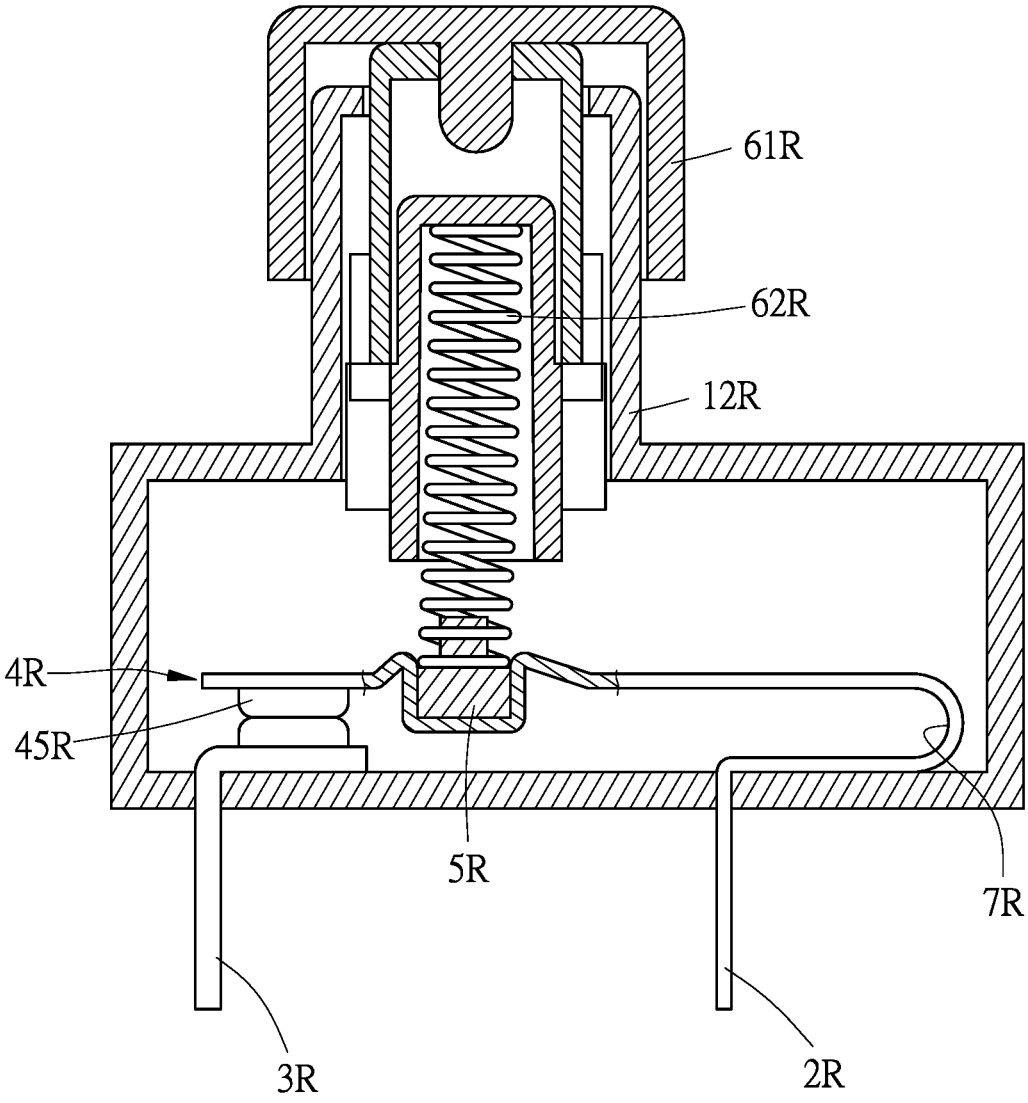
FIG. 11 is a sectional view in accordance with the fourth embodiment of the present invention and illustrates that the push switch is in a connected state.

Referring to FIG. 11, a user operates the operating element (61R) to positionally move relative to the protruding portion (12R), just like operating a button of an automatic ball-point pen, so as to enable the conductive cantilever element (4R) to be selectively contacted with or separated from the second conductive element (3R). When the operating element (61R) is positionally moved towards the conductive cantilever element (4R) and becomes fixed, the operating element (61R) pushes on a silver contact point (45R) of the conductive cantilever element (4R), such that the conductive cantilever element (4R) is contacted with the second elastic element (3R) to form an electrically connected state, and the first elastic element (62R) is further compressed at the same time to increase the first elastic force, thus making the first elastic force greater than the second elastic force at the moment.

Figure 12:
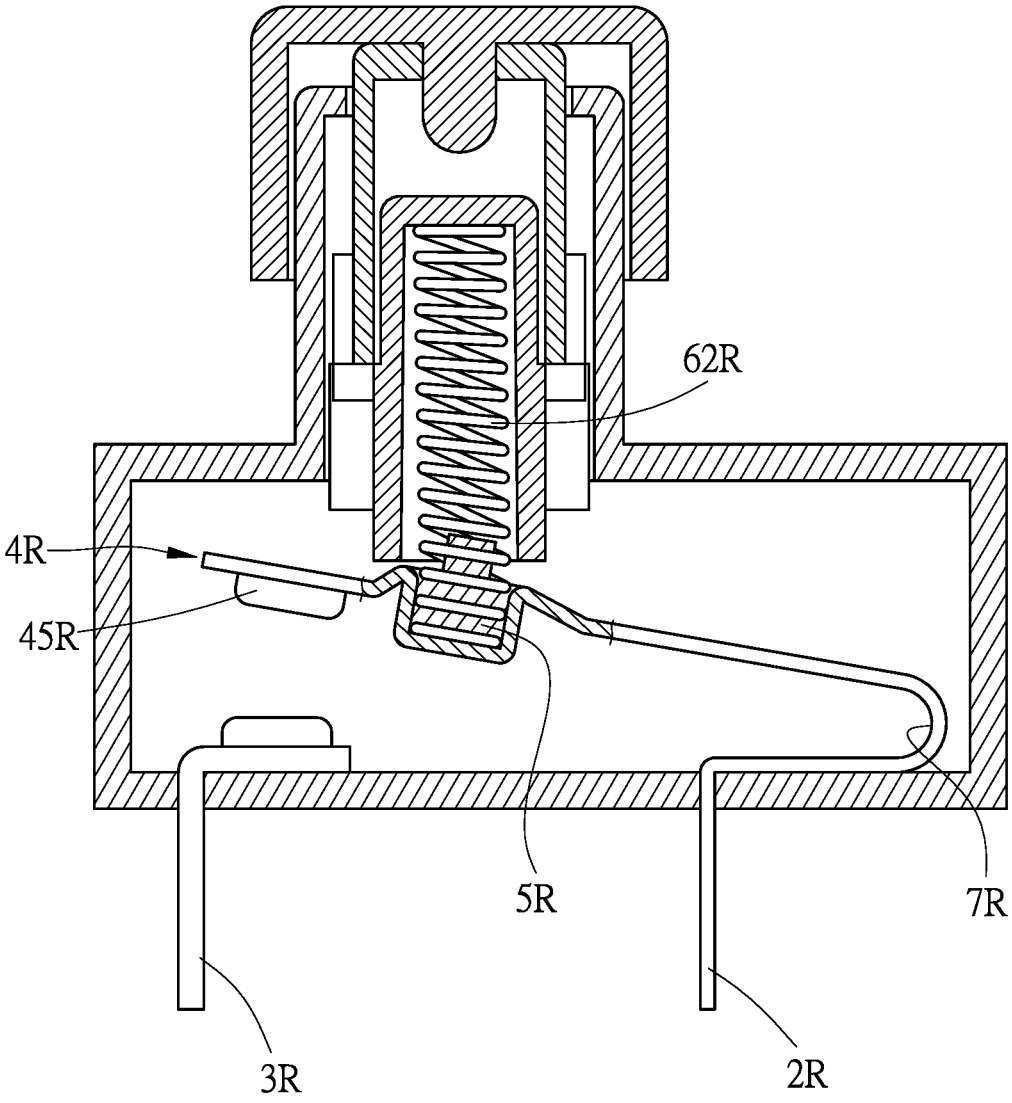
FIG. 12 is a sectional view in accordance with the fourth embodiment of the present invention and illustrates that when the overheating destructive element is overheated and destroyed, a movable conductive element is separated from a second conductive element so as to enable the push switch to be returned to the disconnected state from the connected state.

Referring to FIGS. 11 and 12, when an external conducting apparatus connected to the first conductive element (2R) or the second conductive element (3R) is in an abnormal state; for example, the external conducting apparatus may be a power socket, and when there are oxidized substances, dusts, incomplete insertion of metal pins and deformations of metal pins present between the metal pins of a plug and the power socket, consequently resulting in the generation of a greater heat energy in a conductive part of the power socket, the heat energy is transmitted to the conductive cantilever element (4R) via the first conductive element (2R) or the second conductive element (3R), and then further transmitted to the overheating destructive element (5R) via the conductive cantilever element (4R); the overheating destructive element (5R) absorbs the heat energy and gradually reaches a material melting point thereof, and the rigidity of the overheating destructive element (5R) is gradually lost at this point; for example, the overheating destructive element (5R) may be made of a tin-bismuth alloy, and although a melting point thereof is 148° C., the rigidity is gradually lost when a temperature thereof is close to the melting point. Under the effect of the first elastic force, the overheating destructive element (5R) is compressed by the first elastic element (62R), and then the overheating destructive element (5R) is pressed and deformed or even broken, such that the overheating destructive element (5R) can no longer limit the first elastic element (62R) and the first elastic force is reduced or lost, thus making the second elastic force greater than the first elastic force at this moment, and forcing the conductive cantilever element (4R) to be reset (or slightly sprung back) and the silver contact point (45R) of the conductive cantilever element (4R) to be separated from the second conductive element (3R), thereby forming an electrically disconnected state and achieving protection against overheating.

Figure 13:
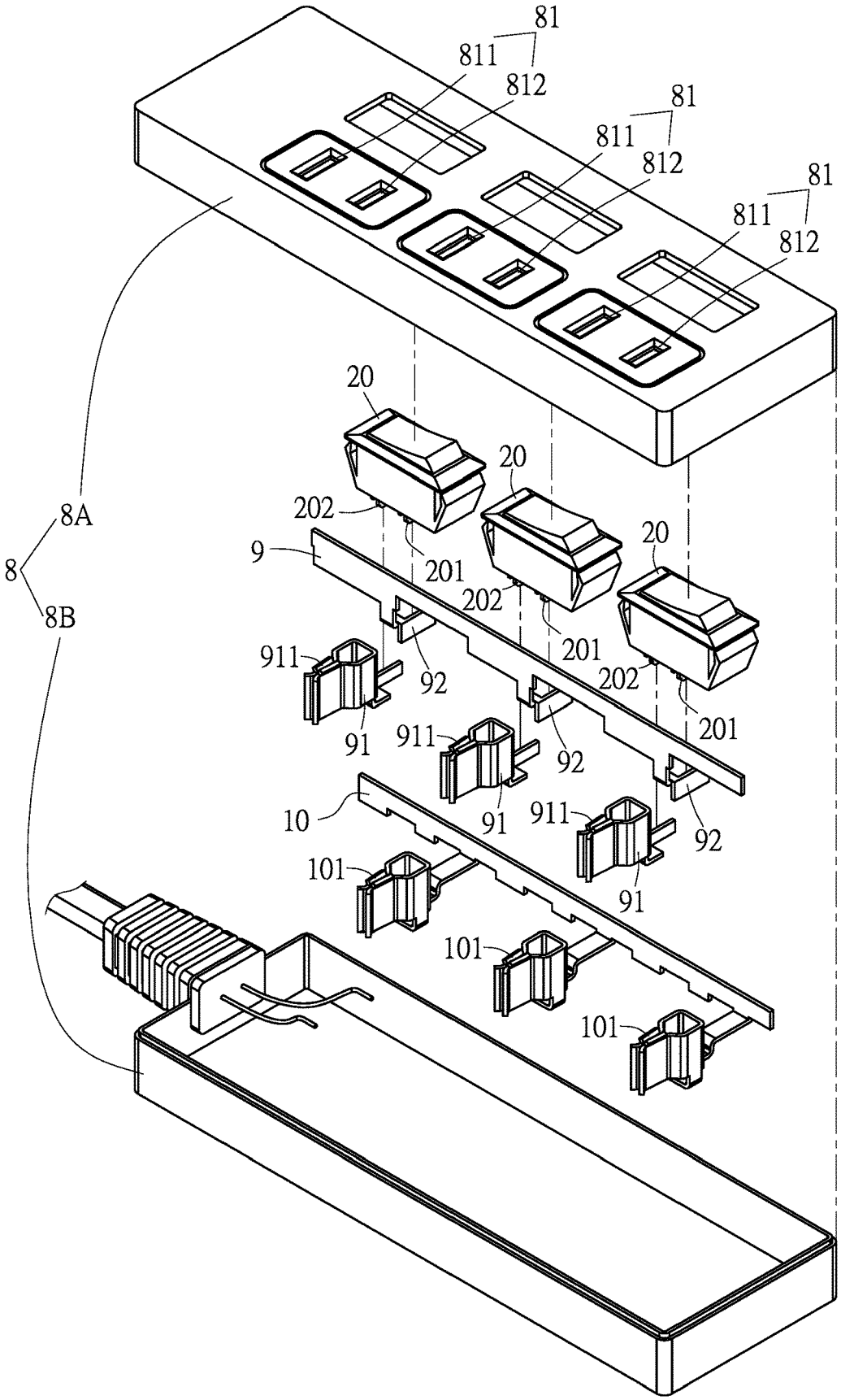
FIG. 13 is a disassembled view showing an overheating destructive switch of the present invention applied to a power socket of an extension cord.
Figure 14:
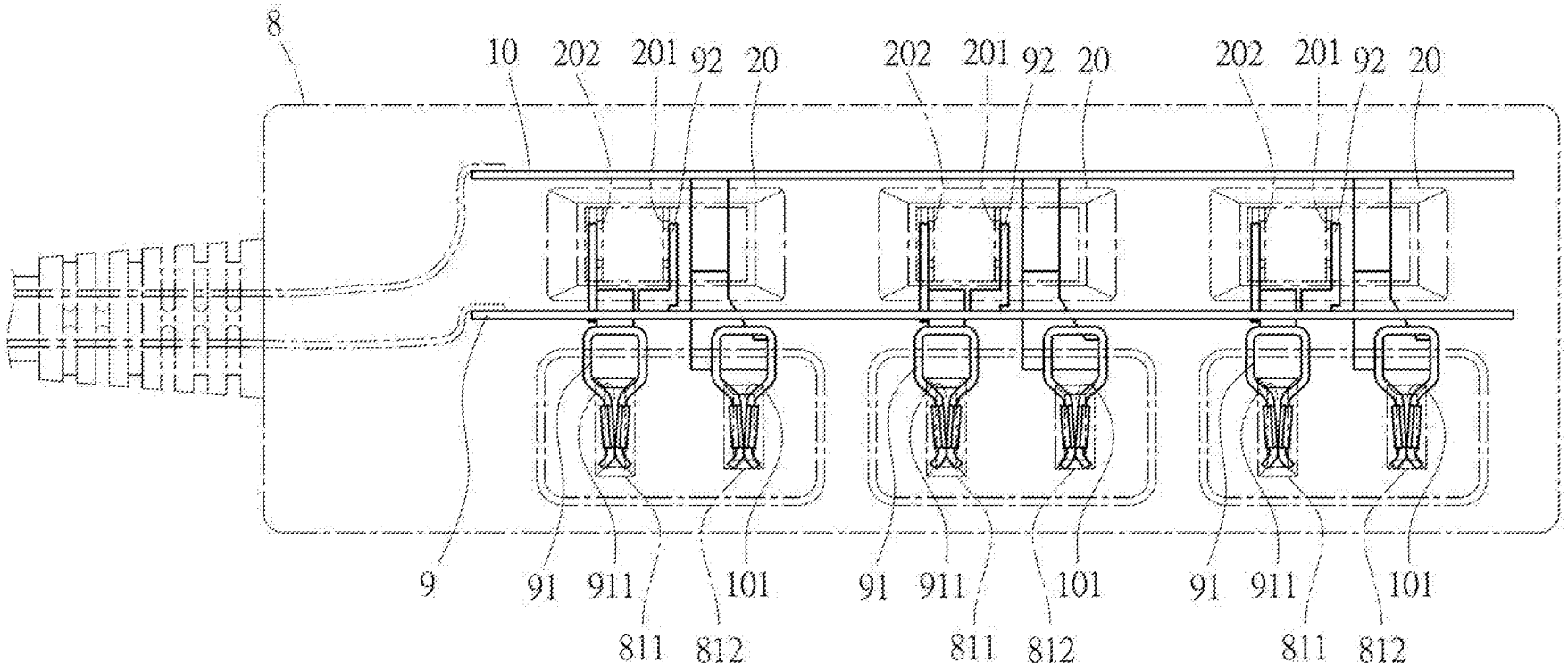
FIG. 14 is a plan view showing an overheating destructive switch of the present invention applied to a power socket of an extension cord.

Referring to FIGS. 13 and 14 for another embodiment of the present invention, the embodiment applies the overheating destructive rocker switch in the previously described embodiment to an extension cord having three sets of socket holes (81), the extension cord comprises:

a shell (8) having an upper shell (8A) and a lower shell (8B), wherein the upper shell (8A) includes the three sets of socket holes (81) and each set of the socket holes (81) includes a live wire jack (811) and a neutral wire jack (812).

A live wire conductive element (9) mounted on the shell (8), wherein the live wire conductive element (9) has three live wire connection ends (92) provided at intervals and in correspondence with three independent live wire pins (91), each of the live wire pins (91) includes a live wire slot (911), and the live wire slot (911) corresponds to the live wire jack (811).

A neutral wire conductive element (10) mounted on the shell (8), wherein the neutral wire conductive element (10) has three neutral wire slots (101) provided at intervals and each of the neutral wire slots (101) are in correspondence with the neutral wire jack (812).

Three overheating destructive switches (20), the overheating destructive switches (20) are described in the aforesaid first embodiment to the fourth embodiment, wherein the first conductive elements (201) of the overheating destructive switches (20) are connected to the live wire connection ends (92) of the live wire conductive element (9) and the second conductive elements (202) are connected to the live wire pins (91); alternatively, the first conductive elements (201) of the overheating destructive switches (20) are connected to the live wire pins (91), and the second conductive elements (202) are connected to the live wire connection ends (92) of the live wire conductive element (9). In this embodiment, the exemplary illustration is that the first conductive elements (201) are connected to the live wire connection ends (92) of the live wire conductive element (9), and the second conductive elements (202) are connected to the live wire pins (91) [the part of connection features are already illustrated in the first embodiment through the third embodiment, and will not be repeated here]. Accordingly, when a working temperature of any of the live wire pins (91) of the extension cord is increased abnormally, the heat energy may be transmitted to the associated overheating destructive switch (20) via the first conductive element (201) or the second conductive element (202), such that the overheating destructive switch (20) is overheated and becomes disconnected to stop power supply; the live wire pin (91) which has an abnormal temperature may terminate the power supply immediately, so that the working temperature is not further increased and the working temperature is reduced as well. Since each of the overheating destructive switches (20) independently controls one set of the live wire jacks (811) and the neutral wire jack (812), when a set of the overheating destructive switches (20) therein is disconnected due to overheating, the live wire jack (811) and the neutral wire jack (812) of the other sets can still function normally and be used further.

In summary of the description of the aforesaid embodiments, it is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An overheating destructive switch, comprising:

a base having a receiving space;

a first conductive element penetrated into and provided in the base;

a second conductive element penetrated into and provided in the base;

a movable conductive element provided in the receiving space, electrically connected to the first conductive element and selectively connected to the second conductive element;

an overheating destructive element destroyable at a destructive temperature, wherein the destructive temperature is between 100° C. to 250° C., and the overheating destructive element is located on the movable conductive element;

an operating component assembled on the base, wherein the operating component comprises an operating element and a first elastic element, the first elastic element is compressively limited between the overheating destructive element and the operating element and has a first elastic force;

a second elastic element having a second elastic force, wherein the second elastic force acts on the operating element;

when the operating element is in a first position, the first elastic force forces the movable conductive element to be contacted with the second conductive element so as to form an electrically connected state, in the electrically connected state, currents flow through the first conductive element, the movable conductive element and the second conductive element to generate a heat energy, and the overheating destructive element absorbs the heat energy and be destroyed at the destructive temperature, such that the first elastic force is reduced or lost resulting in the second elastic force greater than the first elastic force, the second elastic force thus forces the operating element to be moved to a second position and, in consequence, the movable conductive element becomes separated from the second conductive element to form an electrically disconnected state.

2. The overheating destructive switch of claim 1, wherein the first elastic element and the second elastic element are both springs.

3. The overheating destructive switch of claim 1, wherein the movable conductive element is a rocker conductive element, the rocker conductive element is movably provided over the first conductive element, and the rocker conductive element is contacted with or separated from the second conductive element in a manner of rocking motions.

4. The overheating destructive switch of claim 3, wherein the operating element is provided with a pivotal point, the pivotal point is pivotally connected to the base, and the operating element can be rotated reciprocally in a limited manner by having the pivotal point as an axle center, the first elastic element is fixedly connected to the operating element and the overheating destructive element, the first elastic element is located in a position adjacent to the pivotal point and is bent and deformed along with rotations of the operating element.

5. The overheating destructive switch of claim 4, wherein the rocker conductive element has an accommodating groove in a position adjacent to the first conductive element, and the overheating destructive element is located in the accommodating groove.

6. The overheating destructive switch of claim 5, wherein the rocker conductive element is integrally bent to form a first wall, a second wall, and a bottom wall, and the accommodating groove is defined among the first wall, the second wall and the bottom wall.

7. The overheating destructive switch of claim 6, wherein stopping walls are extended from two sides of the bottom wall, and the accommodating groove is collectively defined among the first wall, the second wall, the bottom wall and the stopping walls.

8. The overheating destructive switch of claim 4, wherein the rocker conductive element has a fixing protruding portion in a position adjacent to the first conductive element, and the overheating destructive element is sleeved on the fixing protruding portion.

9. The overheating destructive switch of claim 4, wherein the rocker conductive element has a fixing hole in a position adjacent to the first conductive element; the rocker conductive element further comprising a thermal conductive shell, wherein the thermal conductive shell includes a protruding pillar located at one end of the thermal conductive shell and inserted into the fixing hole; the overheating destructive element is mounted into the thermal conductive shell.

10. The overheating destructive switch of claim 1, wherein the overheating destructive element is a block, a pillar, a cap, a sphere or an irregular body.

* * * * *